US006838220B2

(12) United States Patent
Matsumura et al.

(10) Patent No.: US 6,838,220 B2
(45) Date of Patent: Jan. 4, 2005

(54) TONER FOR DEVELOPING ELECTROSTATIC IMAGE, PROCESS FOR PRODUCING TONER FOR DEVELOPING ELECTROSTATIC IMAGE, DEVELOPER FOR DEVELOPING ELECTROSTATIC IMAGE, AND PROCESS FOR FORMING IMAGE

(75) Inventors: Yasuo Matsumura, Minamiashigara (JP); Takao Ishiyama, Minamiashigara (JP); Hiroshi Takano, Minamiashigara (JP); Masaaki Suwabe, Minamiashigara (JP); Shuji Sato, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/884,090

(22) Filed: Jun. 20, 2001

(65) Prior Publication Data

US 2002/0051925 A1 May 2, 2002

(30) Foreign Application Priority Data

Sep. 5, 2000 (JP) ..... 2000-268679

(51) Int. Cl.[7] ..... G03G 9/097; G03G 9/08

(52) U.S. Cl. ..... 430/110.3; 430/108.1; 430/108.8; 430/110.1; 430/110.4; 430/137.14; 430/124; 430/125

(58) Field of Search ..... 430/110.1, 110.3, 430/111.4, 110.4, 108.1, 108.2, 108.8, 137.14, 124, 125, 126

(56) References Cited

U.S. PATENT DOCUMENTS 5,368,972 A 11/1994 Yamashita et al.
5,698,354 A * 12/1997 Ugai et al. ..... 430/45
5,910,389 A * 6/1999 Matsumura et al. ..... 430/111.4
5,935,751 A 8/1999 Matsuoka et al.
6,022,662 A * 2/2000 Matsumura et al. ..... 430/110.4
6,083,654 A 7/2000 Lin
6,153,346 A * 11/2000 Machata et al. ..... 430/110.4
6,248,494 B1 * 6/2001 Yamazaki et al. ..... 430/110.3

FOREIGN PATENT DOCUMENTS

| | | | |
|---|---|---|---|
| EP | 0 872 774 | A2 | 10/1998 |
| JP | 2-273758 | A | 11/1990 |
| JP | 4-188156 | A | 7/1992 |
| JP | 5-341573 | A | 12/1993 |
| JP | 6-250439 | A | 9/1994 |
| JP | 6-308759 | A | 11/1994 |
| JP | 6-348055 | A | 12/1994 |
| JP | 63-282752 | A | 11/1998 |

OTHER PUBLICATIONS

Trademark Electronic Search System (TESS) Search Report, Serial No. 72062272, Sep., 2002.*

* cited by examiner

*Primary Examiner*—Janis L. Dote
(74) *Attorney, Agent, or Firm*—Oliff & Berridge, PLC

(57) ABSTRACT

A toner for developing an electrostatic image, a process for producing the same, a developer for developing an electrostatic image and a process for forming an image are disclosed. The toner contains a resin, a colorant and a releasing agent, in which the toner has protrusions having a height of about from 0.05 to 2 μm, a part of the protrusions encompasses the releasing agent, and a proportion of elements derived from the releasing agent is about 10% by atom or less based on elements on a surface of the toner that is quantitatively determined by X-ray photoelectron spectroscopy.

17 Claims, No Drawings

TONER FOR DEVELOPING ELECTROSTATIC IMAGE, PROCESS FOR PRODUCING TONER FOR DEVELOPING ELECTROSTATIC IMAGE, DEVELOPER FOR DEVELOPING ELECTROSTATIC IMAGE, AND PROCESS FOR FORMING IMAGE

BACKGROUND OF THE INVENTION

1. Field of the Invention

The present invention relates to a toner for developing an electrostatic image that is used for developing an electrostatic latent image formed by an electrophotographic process or an electrostatic recording process with a developer, a process for producing the same, a developer for developing an electrostatic image, and a process for forming an image.

2. Description of the Related Art

A process for visualizing image information through an electrostatic latent image, such as an electrophotographic process, is being utilized in various fields. In the electrophotographic process, an electrostatic latent image is formed on a photoreceptor through charging and exposing steps, and the electrostatic latent image is developed with a developer containing a toner and then visualized through transferring and fixing steps. The developer includes a two-component developer containing a toner and a carrier, and a one-component toner using solely a magnetic developer or a nonmagnetic toner. A kneading and pulverizing process is generally used for producing a toner, in which a thermoplastic resin is melted and kneaded with a pigment, a charge controlling agent and a releasing agent, such as wax, and after cooling, the mixture is finely pulverized and classified. Inorganic or organic fine particles are sometimes added to the surface of the toner particles depending on necessity, so as to improve the flowability and the cleaning property.

In a color electrophotographic process, which is widely spread in recent years, a releasing agent, such as wax, is generally difficult to be used in order to realize gloss and transparency that are suitable for a color image, i.e., excellent transparency for obtaining an OHP image. Therefore, when a large amount of an oil is applied to a fixing roll for assisting release, sticky feeling in a complex image including an OHP image and difficulty in writing in an image with a pen often occur. In general, wax used for monochrome electrophotography, such as polyethylene, polypropylene and paraffin, is difficult to be used for forming an OHP image because it impairs transparency.

Even when the transparency is not pursued, since a toner produced by the conventional kneading and pulverizing process cannot prevent exposure of a releasing agent to the surface of the toner, problems of remarkable deterioration in flowability and filming on the developing device and the photoreceptor occur upon using as a developer.

As an ultimate solution for removing the problems, such a method for preventing exposure of a releasing agent on the surface by embedding inside the toner is proposed, in which an oily phase containing a monomer as a raw material of a resin and a colorant is dispersed in an aqueous phase and is directly polymerized to form toner particles.

An emulsion polymerization process with aggregation and melt-fusing is proposed in JP-A-63-282752 and JP-A-6-250439 as a production process of a toner, the toner shape and the surface structure of which can be controlled according to the purpose. In the process, a resin particle dispersion is formed by emulsion polymerization, and a colorant dispersion is formed by dispersing a colorant in a solvent, both of which are mixed to form aggregated bodies corresponding to the particle diameter of the toner, followed by integrating the aggregated body by fusing the resin particles under heating.

In the electrophotographic process, in order to maintain the stable performance of a toner under various types of mechanical stress, it is necessary that the exposure of a releasing agent on the toner surface is prevented, and the surface hardness and the surface smoothness of the toner are increased.

The exposure amount of a releasing agent on the toner surface is decreased in order to exhibit the stable releasing performance of the releasing agent even in the case where an oil is applied to a fixing roll and the case where a large amount of an external additive is added to the toner surface. However, in order to exhibit further the releasing performance upon fixing, it is desirable that the releasing agent is present in the vicinity of the toner surface.

It is an important problem in recent years that the color electrophotographic process involves a problem in consuming electric power. Since a color image is formed with three layers, i.e., cyan, magenta and yellow, in a high density area, the height of the toner layer becomes larger than a monochrome image, and electric power required for fixing the color image becomes larger. Accompanying the wide spread of the color electrophotographic process, the increase in consuming electric power upon fixing becomes the limiting factor of the process speed.

Therefore, a color toner that can be fixed at a lower temperature is demanded. However, when the molecular weight or the glass transition temperature of the binder resin is simply decreased, problems occur in offset at a high temperature and preservation property of an image (such as sticking of documents upon accumulating the documents or allowing a booklet to stand at a high temperature) after fixing.

In the case where a large amount of wax having a relatively low melting point is used or the glass transition point of the binder resin is decreased to prevent offset at a high temperature, when a document fixed in a duplicating machine as an original copy is supplied to an automatic copy feeding machine, a part of a toner image is adhered to a document table due to heat from the document table and friction caused by the automatic copy feeding machine, so as to cause contamination of the document table.

SUMMARY OF THE INVENTION

Therefore, it is particularly important to control addition of the optimum wax to a color toner at a minimum amount with an optimum structure to solve the above problems.

The invention has been made in view of the foregoing circumstances and provides a toner for developing an electrostatic image, a process for producing the same, a developer for developing an electrostatic image, and a process for forming an image having the following characteristic features.

(1) A toner is provided that exhibits stable releasing property upon fixing without application of an oil to a fixing roll.

(2) A toner is provided that exhibits stable releasing property even under the conditions that an external additive for improving the flowability and the transferring property is applied.

(3) A toner is provided in that the lowest fixing temperature is low, and it is good in prevention of offset at a high temperature and in the storage property of an image.

(4) A toner is provided that has a high flowability and good transfer performance to realize high image quality.

(5) A developer of high reliability is provided that is good in charge maintaining property and does not cause contamination of a photoreceptor.

(6) A process that can stably produce the toner is provided.

(7) A process for forming an image is provided that can form a fine image of high quality for a long period of time by using the toner.

According to a first aspect of the present invention, a toner for developing an electrostatic image contains a resin, a colorant and a releasing agent. The toner has protrusions having a height of approximately 0.05 μm to 2 μm on the surface thereof, a part of the protrusions contain the releasing agent inside thereof, and the toner is characterized by a ratio of an element derived from the releasing agent to the elements on the surface of the toner determined by X-ray photoelectron spectroscopy. The element ratio is smaller than 10% by atom.

The protrusions may have a height of approximately from 0.1 to 1 μm.

At least the part of the protrusions containing the releasing agent inside may be formed by migration of the releasing agent.

The releasing agent in the protrusions may have an acicular form.

The toner particles may have a surface property index defined by the following equations of approximately 2.0 or less which is measured under the condition of the toner without external additive:

$$\text{(Surface property index)}=\text{(Measured specific surface area)}/\text{(Calculated specific surface area)}\text{(Calculated specific surface area)}=6\Sigma(n\times R^2)/(\rho\times\Sigma(n\times R^3))$$

wherein n represents a number of particles in a channel of a COULTER COUNTER, R represents a channel particle diameter in the COULTER COUNTER, and ρ represents a toner density.

The surface property index may be in the range of about from 1.0 to 1.8.

The toner may have an external additive added to a surface of the toner particles, and the external additive may have an average primary particle diameter of about 0.2 μm or less, and the external additive may be added in an amount of about from 1 to 3 parts by weight per 100 parts by weight of the toner.

The toner may have a volume average particle diameter ($D_{50}$) of about from 2 to 10 μm.

The toner may have a shape factor SF1 of about from 100 to 140. The SF1 may be defined by the following equation:

$$SF1=(ML^2/A)\times(\pi/4)\times 100$$

wherein ML represents a maximum length of the toner particles, and A represents a projected area of the toner particles.

The toner may have a volume average particle size distribution index GSDv of about 1.25 or less. The GSDv may be defined by the following equation:

$$GSDv=(D_{84v}/D_{16v})^{0.5}$$

wherein $D_{84v}$ represents a diameter (μm) at which the volume accumulated particle distribution becomes 84%, and $D_{16v}$ represents a diameter (μm) at which the volume accumulated particle distribution becomes 16%.

The releasing agent may be selected from the group of polyethylene wax, paraffin wax, Fischer-Tropsch wax and nitrogen containing wax.

According to a second aspect of the present invention, a developer for developing an electrostatic image contains a toner and a carrier. The toner has protrusions having a height of approximately 0.05 μm to 2 μm on the surface thereof, a part of the protrusions contain a releasing agent inside thereof, and a ratio of an element derived from the releasing agent to the elements on the surface of the toner determined by X-ray photoelectron spectroscopy. The element ratio is smaller than 10% by atom.

The toner particles may have a surface property index of approximately 2.0 or less which is measured under the condition of the toner without external additive.

The toner may have a volume average particle size distribution index GSDv of about 1.25 or less.

According to a third aspect of the present invention, a process for producing the toner of the first aspect includes the steps of: mixing at least a resin particle dispersion and a releasing agent dispersion to prepare an aggregated particle dispersion; heating the aggregated particle dispersion to form the toner particles; and forming protrusions on a surface of the toner by migration of the releasing agent.

The step of heating the aggregated particles dispersion may include an intermediate step of heating at a temperature in a range of ±20° C. from the melting point of the releasing agent, for 2 to 10 hours.

According to a fourth aspect of the present invention, a process for forming an image includes the steps of: forming an electrostatic latent image on an electrostatic image holding member; developing the electrostatic latent image with the developer of the second aspect on a developer holding member to form a toner image; transferring the toner image to a transfer material; and fixing the toner image on the transfer material.

The process may further include the step of recovering the toner remaining on the electrostatic image holding member and reusing the toner in the developing step.

The transferring step may include a step of transferring the toner image to an intermediate transfer material, and a step of transferring the toner image to a final transfer material.

The fixing step may employ an oilless fixing process.

DETAILED DESCRIPTION OF THE PREFERRED EMBODIMENTS

In a roll fixing method under the state where an oil is not applied, it is important that a releasing agent in the toner effuses effectively to the interface between a toner fixed image and the fixing roll by heat and pressure upon fixing. In order to ensure the effusion, it has been found that it is effective to increase the amount of the releasing agent in the toner and to increase the domain size of the releasing agent in the toner. It has been also found that the position of the releasing agent in the toner is important. In order to obtain a high transfer efficiency, there are cases where a large amount of an external additive is added to the surface of the toner. In these cases, since the effusion of the releasing agent is suppressed by the external additive, it is important that the releasing agent is present in the vicinity of the toner surface to exhibit the function of the releasing agent. When a releasing agent having adhesiveness, such as wax, is exposed on the toner surface, on the other hand, the external additive is adhered selectively on the part where the releasing agent is exposed, so as to bring about problems in deterioration of the transfer efficiency and deterioration of developing property.

As a result of earnest investigations made by the inventors, it has been found that in order to realize the optimum structure of the releasing agent, the following structure is important for realizing both the fixing and releasing property and the other performance including transfer and development. That is, in a toner having plural domains of a releasing agent, the releasing agent is present in the form of protrusion in the vicinity of the toner surface, but the releasing agent is covered with a thin film of a binder resin and is substantially not exposed on the toner surface.

Therefore, in the toner for developing an electrostatic image of the invention, it is important that the toner has protrusions having a height of about from 0.05 to 2 μm, the protrusions encompass the releasing agent, and a proportion of elements ascribed to the releasing agent is about 10% by atom or less based on elements on the toner surface that is quantitatively determined by X-ray photoelectron spectroscopy.

The size of the protrusions is measured by observing the cross section of the toner with a transmitting electron microscope and measuring the height thereof from the base position where the circumference of the protrusion is 1 μm. When the height of the protrusions exceeds 2 μm, the releasing agent is liable to effuse on the toner surface, and the shape of the toner deviates from the spherical shape to cause deterioration of the transferring property and the developing property due to distortion of the shape. When the height of the protrusions is less than 0.03 μm, the releasing agent is hard to effuse effectively on fixing to make difficult to ensure the releasing property. In particular, when an external additive is applied, deterioration of the fixing and releasing properties becomes conspicuous since the effusion of the releasing agent is suppressed. The term "encompass" herein means that a part of the releasing agent is contained in the protrusion above the base position. In the invention, it is not necessary that all the protrusions encompass the releasing agent, and it is preferred that half or more of the protrusions encompass the releasing agent.

The exposure amount of the releasing agent on the toner surface can be quantitatively determined by X-ray photoelectron spectroscopy (XPS). In this method, spectra of the respective materials constituting the toner, i.e., the binder resin, the colorant and the releasing agent, are measured, and a spectrum obtained by measuring the toner particles is subjected to fitting with the spectra of the respective materials, whereby the surface exposure ratio of the releasing agent is determined for the respective toner particles. Specifically, it is determined in terms of a proportion of elements ascribed to the releasing agent measured by XPS. In the invention, it is important to suppress the proportion of elements ascribed to the releasing agent to about 10% by atom or less. When it exceeds about 10% by atom, it is not preferred since problems occur in the transferring property and the developing property. The proportion of elements is more preferably 8% by atom or less.

According to the conventional kneading and pulverizing process, however, it is impossible to arrange the releasing agent in the toner in this manner.

The inventors have succeeded to produce the toner having the foregoing structure through investigations of production of toners by an aggregation and melt-fusing process. In production process of a toner according to the aggregation and melt-fusing process, a resin particle dispersion, a colorant dispersion and a releasing agent dispersion are mixed to cause aggregation, so as to prepare an aggregated particle dispersion, which is then heated to fuse the resin particles to form toner particles. The inventors have succeeded that when the fusing conditions are adjusted, the releasing agent particles migrate to the toner surface to form protrusions on the toner surface, and the exposure of the releasing agent can be substantially suppressed. While the fusing conditions cannot be determined unconditionally in relation to the kinds of the releasing agent and the binder resin and the other production conditions, the selection of the conditions for fusing and integration can be easily conducted when the prerequisites.

Among the conditions, such a process is extremely useful for controlling the structure of the toner in that aggregated particles are formed with resin particles, releasing agent particles and pigment particles, and then the surface thereof is covered with resin particles to form a shell layer, followed by conducting heat-fusing.

In the process, the melting point and the viscosity of the releasing agent, the heating temperature and the heating time are important factors for controlling the structure of the toner. In general, the migration rate of the releasing agent to the toner surface becomes larger to make the migration amount larger when the melting point is lower, the melt viscosity is smaller, the heating temperature upon heat-fusing is higher, and the heating time is longer. Preferably, the migration of the releasing agent can be effected by maintaining at a temperature in a range of ±20° C. from the melting point of the releasing agent for a period of from 2 to 10 hours.

In the toner for developing an electrostatic image of the invention, when the amount of the protrusions is too large, the toner surface cannot be sufficiently covered with an external additive to fail to sufficiently ensure the transferring property and the developing property. Therefore, it is important in the invention that the toner having no external additive added has a surface property index defined by the following equations of 2.0 or less:

$$\text{(Surface property index)}=\text{(Measured specific surface area)}/\text{(Calculated specific surface area)}\text{(Calculated specific surface area)}=6\Sigma(n\times R^2)/(\rho\times\Sigma(n\times R^3))$$

wherein n represents a number of particles in a channel of a COULTER COUNTER, R represents a channel particle diameter in the COULTER COUNTER, and ρ represents a toner density.

The volume average particle size distribution index GSDv of the toner can be expressed by the following equation, and the GSDv in the invention is preferably adjusted to about 1.25 or less. When the GSDv exceeds 1.25, problems in image quality, such as roughening of thin lines and nonuniformity of images, occur. The GSDv is more preferably 1.23 or less.

$$GSDv=(D_{84v}/D_{16v})^{0.5}$$

wherein $D_{84v}$ represents the particle diameter (μm), at which the volume accumulated distribution becomes 84%, and $D_{16v}$ represents the particle diameter (μm), at which the volume accumulated distribution becomes 16%.

The shape factor SF1 of the toner can be expressed by the following equation, and the shape factor SF1 of the toner of the invention is preferably in the range of from 100 to 140. When the SF1 exceeds 140, problems, such as nonuniformity of a solid image, occur due to decrease in transfer efficiency.

$$SF1=(ML^2/A)\times(\pi/4)\times 100$$

wherein ML represents the absolute maximum length of the toner particles, and A represents the projected area of the toner particles.

These factors can be digitized mainly by analyzing micrographs and scanning electron micrographs with an image analyzer.

The volume average particle diameter ($D_{50}$) of the toner of the invention is generally in the range of from 2 to 10 $\mu$m, and preferably in the range of from 3 to 8 $\mu$m.

Any type of known wax can be used as the releasing agent used in the invention, and highly crystalline polyethylene wax having a relatively low molecular weight, paraffin wax, Fischer-Tropsch wax, amide wax, and polar wax containing nitrogen, such as a urethane compound are particularly effective. Polyethylene wax having a molecular weight of 1,000 or less is particularly effective, and one having a molecular weight of from 300 to 1,000 is more preferred.

The compound containing a urethane bond is preferred since it can maintain the solid state, and the melting point can be set at a relatively high value considering the molecular weight, owing to a high aggregation force due to the polar groups even it has a lower molecular weight. The molecular weight is preferably in the range of from 300 to 1,000. Various combinations can be used as the raw materials, such as a combination of a diisocyanic acid compound and a monoalcohol, a combination of a monoisocyanic acid compound and a monoalcohol, a combination of a dialcohol and a monoisocyanic acid compound, a combination of a trialcohol and a monoisocyanic acid compound, and a combination of a triisocyanic acid compound and a monoalcohol. In order to prevent increase of the molecular weight, it is preferred to combine a polyfunctional compound and a monofunctional compound, and it is important that the amounts of the functional groups of the raw materials are equivalent.

Specific examples of the raw materials are as follows.

(1) Examples of the monoisocyanic acid compound include dodecyl isocyanate, phenyl isocyanate and a derivative thereof, naphthyl isocyanate, hexyl isocyanate, benzyl isocyanate, butyl isocyanate and allyl isocyanate.

(2) Examples of the diisocyanic acid compound include tolyienediisocyanate, 4,4'-diphenylmethanediisocyanate, toluenediisocyanate, 1,3-phenylenediisocyanate, hexamethylenediisocyanate, 4-methyl-m-phenylenediisocyanate and isophoronediisocyanate.

(3) Examples of the monoalcohol include an ordinary alcohol, such as methanol, ethanol, propanol, butanol, pentanol, hexanol and heptanol.

(4) Examples of the dialcohol include various kinds of glycol, such as ethylene glycol, diethylene glycol, triethylene glycol and trimethylene glycol.

(5) Examples of the trialcohol include trimethylolpropane, triethylolpropane and trimethanolethane.

The foregoing raw materials can be used, but the invention is not limited to these specific examples.

The urethane compound can be used in a kneading and pulverization type toner by mixing with the resin and the colorant upon kneading like an ordinary releasing agent. In the case where the urethane compound is used in the toner produced by the emulsion polymerization process with aggregation and melt-fusing, it can be used in such a manner that it is dispersed in water along with an ionic surfactant or a polymer electrolyte, such as a polymer acid and a polymer base, and formed into fine particles by applying a large shearing force by a homogenizer or a pressure discharge dispenser under heating to a melting point or higher, so as to prepare a releasing agent dispersion of 1 $\mu$m or less, which is used with the resin particle dispersion and the colorant dispersion.

Examples of the colorant used in the invention include various pigments, such as carbon black, Chrome Yellow, Hansa Yellow, Benzidine Yellow, Suren Yellow, Quinoline Yellow, Permanent Orange GTR, Pyrazolone Orange, Vulkan Orange, Watchyoung Red, Permanent Red, Brilliant Carmine 3B, Brilliant Carmine 6B, DU PONT Oil Red, Pyrazolone Red, LITHOL Red, Rhodainine B Lake, Lake Red C, Rose Bengal, Aniline Blue, Ultramarine Blue, Calco Oil Blue, Methylene Blue Chloride, Phthalocyanine Blue, Phthalocyanine Green and Malachite Green Oxalate, and various dyes, such as acridine series, xanthene series, azo series, benzoquinone series, azine series, anthraquinone series, thioindigo series, dioxazine series, thiazine series, azomethine series, indigo series, phthalocyanine series, aniline black series, polymethine series, triphenylmethane series, diphenylmethane series and thiazole series , which can be used solely or in combination of a plurality thereof.

Examples of the binder resin used in the invention include a homopolymer or a copolymer of a vinyl series monomer, examples of which include a styrene compound, such as styrene and parachlorostyrene; a vinyl ester compound, such as vinyl naphthalene, vinyl chloride, vinyl bromide, vinyl fluoride, vinyl acetate, vinyl propionate, vinyl benzoate and vinyl butyrate; a methylene aliphatic carboxylate compound, such as methyl acrylate, ethyl acrylate, n-butyl acrylate, isobutyl acrylate, dodecyl acrylate, n-octyl acrylate, 2-chloroethyl acrylate, phenyl acrylate, methyl $\alpha$-chloroacrylate, methyl methacrylate, ethyl methacrylate and butyl methacrylate; a vinyl nitrile compound, such as acrylonitrile, methacrylonitrile and acrylamide; a vinyl ether compound, such as vinyl methyl ether, vinyl ethyl ether and vinyl isobutyl ether; an N-vinyl compound, such as N-vinylpyrrole, N-vinylcarbazole, N-vinylindole and N-vinylpirrolidone; and a vinyl carboxylic acid compound, such as methacrylic acid, acrylic acid and cinnamic acid, and various polyesters. Various kinds of wax can also be used in combination.

An internal additive, a charge controlling agent and inorganic fine particles may be mixed in the toner according to the invention.

Examples of the internal additive that can be used in the invention include a magnetic material, such as a metal, an alloy and a compound containing the metal, examples of which include ferrite, magnetite, reduced iron, cobalt, nickel and manganese.

Examples of the charge controlling agent that can be used in the invention include various charge controlling agents that are ordinarily employed, such as a dye containing a quaternary ammonium salt compound, a nigrosine series compound and a complex of aluminum, iron or chromium, and a triphenylmethane series pigment. A water-insoluble material is preferred from the standpoint of control of ionic strength which influences the stability during aggregation or fusion, and reduction of waste water pollution.

Examples of the inorganic fine particles that can be used in the invention include all the ordinary external additives added to the toner surface, such as silica, alumina, titania, calcium carbonate, magnesium carbonate and tricalcium phosphate, which are preferably used after dispersing with an ionic surfactant, a polymer acid or a polymer base.

A surfactant may be used for conducting emulsion polymerization, seed polymerization, dispersion of the pigment, dispersion of the resin particles, dispersion of the releasing agent, aggregation and stabilization of these operations.

It is effective to use, in combination therewith, an anionic surfactant, such as a sulfate series, a sulfonate series, a phosphate series and a soap series, a cationic surfactant, such as an amine salt type and a quaternary ammonium salt type, and a nonionic surfactant, such as a polyethylene glycol series, an alkylphenol ethylene oxide adduct series and a polyhydric alcohol series.

As a dispersing method therefor, the ordinary methods, such as a rotation shearing type homogenizer, a ball mill containing media, a sand mill and a Dynomill, may be used.

There is no particular restriction on the carrier and there are known carriers, such as a resin-coated carrier, etc. The resin-coated carrier is prepared by coating a resin on the surface of a core material. Examples of the core material include powders having a magnetism, such as, an iron powder, a ferrite powder, a nickel powder, etc. Examples of the above-described resin include a fluorine-base resin, a vinyl-base resin, a silicone-base resin, etc.

Embodiment 1

Preparation of Urethane Compound A

| | |
|---|---|
| Hexamethylene diisocyanate (produced by Wako Pure Chemical Industries, Ltd.) | 208 g |
| n-Propyl alcohol (produced by Wako Pure Chemical Industries, Ltd.) | 148.8 g |

The foregoing materials are weighed in a 1-L separable flask and maintained at 85° C. under stirring with a magnet stirrer chip. The mixture becomes whitely clouded after about 3 hours, and is completely solidified after 4 hours. Heating is further continued to maintain the mixture at 85° C. for 6 hours in total, so as to completely finish the reaction.

The resulting urethane compound is taken out from the separable flask and is pulverized to powder by a sample mill. It is designated as a urethane compound A (molecular weight: 288, melting point: 99.1° C. (the peak value on a differential scanning calorimeter)).

Preparation of Toner Particles

| | |
|---|---|
| Styrene | 75 parts by weight |
| n-Butyl acrylate | 14 parts by weight |
| Blue pigment (PB 15:3, produced by Dainichiseika Color and Chemicals Mfg Co., Ltd.) | 5 parts by weight |
| Urethane compound A | 6 parts by weight |

The foregoing materials are dispersed in a ball mill for 5 hours, and 0.4 part by weight of benzoyl peroxide as a polymerization initiator is added thereto to prepare a dispersion. The dispersion is added to 200 parts by weight of water along with 20 parts by weight of calcium carbonate (RUMINAS, produced by Maruo Calcium Co., Ltd.), and the mixture is mixed and dispersed in a round stainless steel flask with a homogenizer (ULTRA-TURRAX T50, produced by IKA Corp.), and is heated to 85° C. over an oil bath for heating under stirring inside the flask, followed by maintaining for 5 hours.

Thereafter, the flask is sealed and heated to 105° C. and maintained for 1 hour. The flask is then cooled, and the content thereof is filtered and washed, followed by drying, to obtain cyan toner particles.

Properties of Toner Particles

The resulting toner particles have an average particle diameter of 7.5 $\mu$m and a volume average particle size distribution index GSDv of 1.32. Image analysis of the toner reveals that the shape factor SF1 is 122 and the surface property index is 1.50.

Observation of the surface of the toner with a scanning electron microscope and a transmission electron microscope reveals that protrusions having a height of 0.4 $\mu$m are found on the toner surface, and observation with a transmission electron microscope reveals that plural releasing agent domains are present inside the toner particles. It is also found that the releasing agent is present inside the protrusions. The ratio of nitrogen atoms ascribed to the releasing agent (corresponding to the exposure ratio of the releasing agent) on the toner surface is quantitatively determined by XPS, and it exhibits a low value of 5% by atom.

Preparation of Developer

The toner is mixed with 1.2% by weight of silica (TS720, produced by Cabot Corp.), which has an average primary particle size of 12 nm, to obtain an externally added toner. Separately, a ferrite core having an average particle diameter of 50 $\mu$m is coated with 1% by weight of polymethyl methacrylate (produced by Souken Kagaku Co., Ltd.) to obtain a carrier. The externally added toner and the coated carrier are mixed to obtain a developer having a toner concentration of 6.0% by weight.

Evaluation of Developer

The developer is applied to a modified machine obtained by installing a heat fixing roll having a surface layer of a fluorine resin in a duplicator (DP1250, produced by Fuji Xerox Co., Ltd.) to evaluate image quality, and it reveals that a clear image with no fogging is obtained. Slight unevenness in image density is found in a solid image, but it causes no practical problem.

While the fixing temperature of the heat fixing roll is varied from 120 to 240° C., twisting on a fixing roll and releasing property from the heat fixing roll are investigated, and it reveals that slight tendency of twisting on the fixing roll is observed in a low temperature range, but the releasing property that causes no practical problem is obtained. The fixing degree is determined by scrubbing with cotton waste, and it is found that a sufficient fixing degree is obtained from 150° C., and thus 150° C. is designated as the lowest fixing temperature. It is found that high temperature offset slightly occurs at a temperature exceeding 200° C.

Embodiment 2

Preparation of Resin Particle Dispersion (1)

| | |
|---|---|
| Styrene | 320 g |
| n-Butyl acrylate | 80 g |
| Acrylic acid | 6 g |
| Dodecanethiol | 3 g |
| Carbon tetrachloride | 4 g |

The foregoing components are mixed and dissolved to prepare a solution. A surfactant solution formed by dissolving 6 g of a nonionic surfactant (NONIPOL 400, produced by Sanyo Chemical Industries, Ltd.) and 10 g of an anionic surface active agent (NEOGEN SC, produced by Dai-ichi Kogyo Seiyaku Co., Ltd.) in 550 g of ion exchanged water is placed in a flask, and the solution obtained above is dispersed and emulsified therein. The emulsion is slowly stirred over 10 minutes, during which 50 g of ion exchanged water having 4 g of ammonium persulfate dissolved therein is added thereto, followed by substituting with nitrogen. Thereafter, the content of the flask is heated to 70° C. over an oil bath under stirring, and the emulsion polymerization is continued for 5 hours to obtain a resin particle dispersion (1). The resin particles are separated from the resin particle dispersion (1) and measured for various characteristics, and it is found that the mean diameter is 180 nm, the glass transition point is 54.5° C., the weight average molecular weight Mw is 38,000, and the number average molecular weight Mn is 10,500.

Preparation of Pigment Dispersion (1)

| | |
|---|---|
| Blue pigment (copper phthalocyanine) (PB 15:3, produced by Dainichiseika Color and Chemicals Mfg Co., Ltd.) | 50 g |
| Anionic surfactant (Neogen SC, produced by Dai-ichi Kogyo Seiyaku Co., Ltd.) | 5 g |
| Ion exchanged water | 200 g |

The foregoing components are mixed and dissolved, and the mixture is dispersed by using a homogenizer (ULTRA-TURRAX, produced by IKA Corp.) and an ultrasonic wave irradiator, so as to obtain a blue pigment dispersion (1) having a mean diameter of 140 nm.

Preparation of Releasing Agent Dispersion (1)

| | |
|---|---|
| Polyethylene wax | 50 g |
| Polyethylene wax (Polywax 725, produced by Toyo Petrolight Co., Ltd.) | 50 g |
| Anionic surfactant (Neogen SC, produced by Dai-ichi Kogyo Seiyaku Co., Ltd.) | 5 g |
| Ion exchanged water | 200 g |

The foregoing components are heated to 105° C., and the mixture is dispersed by a homogenizer (ULTRA-TURRAX T50, produced by IKA Corp.) and is further subjected to a dispersing treatment by a pressure discharge type homogenizer, so as to obtain a releasing agent dispersion (1) having a mean diameter of 170 nm.

Production of Aggregated Particles

| | |
|---|---|
| Resin particle dispersion (1) | 200 g |
| Pigment dispersion (1) | 30 g |
| Releasing agent dispersion (1) | 40 g |
| Aqueous solution (10% by weight) of polyaluminum chloride (produced by Asada Chemical Co., Ltd.) | 1.5 g |

The foregoing components are mixed and dispersed in a round stainless steel flask with a homogenizer (ULTRA-TURRAX T50, produced by IKA Corp.), and is then heated to 50° C. over an oil bath for heating under stirring inside the flask. After maintaining at 50° C. for 30 minutes, observation with an optical microscope reveals that it is confirmed that aggregated particles having an average particle diameter of about 5.5 μm are formed. 100 g of the resin particle dispersion (1) is gradually added to the resulting aggregated particle dispersion, and the mixture is heated to 52° C. by increasing the temperature of the oil bath for heating, followed by maintaining at that temperature for 1 hour, whereby an aggregated particle dispersion is obtained.

Observation with an optical microscope reveals that it is confirmed that aggregated particles having an average particle diameter of about 6.0 μm are formed.

Production of Toner Particles 15 g of a 1N sodium hydroxide solution is added to the resulting aggregated particle dispersion, which is heated to 96° C. with continuous stirring, followed by maintaining at that temperature for 6 hours. Thereafter, it is cooled, filtered and sufficiently washed with ion exchange water to obtain toner particles. The average particle diameter of the toner particles measured with a COULTER COUNTER is 6.0 μm.

Properties of Toner Particles

The resulting toner particles have a volume average particle size distribution index GSDv of 1.25, a shape factor SF1 of 120, which means a substantially spherical shape, and a surface property index of 1.40. Observation of the surface of the toner with a scanning electron microscope and a transmission electron microscope reveals that protrusions having a height of 0.8 μm are found on the toner surface, and observation with a transmission electron microscope reveals that the releasing agent is present inside the protrusions.

The ratio of carbon atoms ascribed to the releasing agent on the toner surface is quantitatively determined by XPS, and it exhibits a low value of 4.0% by atom.

Preparation of Developer

The toner particles are mixed with 2% by weight of silica (TS720, produced by Cabot Corp.), which has an average primary particle size of 12 nm, to obtain an externally added toner. Separately, a ferrite core having an average particle diameter of 50 μm is coated with 1% by weight of polymethyl methacrylate (produced by Souken Kagaku Co., Ltd.) to obtain a carrier. The externally added toner and the carrier are mixed to obtain a developer having a toner concentration of 8% by weight.

Evaluation of Developer

The developer is applied to a modified machine obtained by installing a heat fixing roll having a surface layer of a fluorine resin in a duplicator (DP1250, produced by Fuji Xerox Co., Ltd.) to evaluate image quality, and it reveals that a clear image with no fogging is obtained. The uniformity of the density of a solid image is extremely good. The fog-forming concentration, at which background fog becomes conspicuous, is evaluated by increasing the toner concentration, and it is found the fog-forming concentration is 10%, and the toner can be used in an extremely wide range of the toner concentration.

While the fixing temperature of the heat fixing roll having a surface layer of a fluorine resin is varied from 120 to 240° C., releasing property from the heat fixing roll is investigated, and it reveals that perfect releasing property is obtained throughout the whole temperature range. The fixing degree is determined by scrubbing with cotton waste, and it is found that a sufficient fixing degree is obtained from 130° C., and thus 130° C. is designated as the lowest fixing temperature. It is found that high temperature offset slightly occurs at a temperature exceeding 220° C.

Comparative Example 1

In the production of the toner particles in Example 2, after preparing the aggregated particle dispersion, the temperature for fusing in the flask is changed to 90° C., which is maintained for 4 hours to conduct fusion and integration, so as to obtain toner particles.

The resulting toner particles have a volume average particle diameter $D_{50}$ of 5.9 μm, a volume average particle size distribution index GSDv of 1.25, a shape factor SF1 of 125, which means a spherical shape, and a surface property index of 1.20.

Observation of the surface of the toner particles with a scanning electron microscope and a transmission electron microscope reveals that protrusions having a height of 0.20 μm are found on the toner surface, but the releasing agent is not confirmed inside the protrusions, and observation with a transmission electron microscope reveals that the releasing agent is uniformly dispersed inside the toner particles.

The ratio of carbon atoms ascribed to the releasing agent on the toner surface is quantitatively determined by XPS, and it is 1.8% by atom.

The toner particles are mixed with 2% by weight of silica (TS720, produced by Cabot Corp.), which has an average primary particle size of 12 nm, to obtain an externally added toner. Separately, a ferrite core having an average particle diameter of 50 μm is coated with 1% by weight of polymethyl methacrylate (produced by Souken Kagaku Co., Ltd.) to obtain a carrier. The externally added toner and the carrier are mixed to obtain a developer having a toner concentration of 8% by weight.

Evaluation of Developer

The developer is applied to a modified machine obtained by installing a heat fixing roll having a surface layer of a fluorine resin in a duplicator (DP1250, produced by Fuji Xerox Co., Ltd.) to evaluate image quality, and it reveals that a clear image with no fogging is obtained. The uniformity of the density of a solid image is extremely good. The fog-forming concentration, at which background fog becomes conspicuous, is evaluated by increasing the toner concentration, and it is found the fog-forming concentration is 10%, and the toner can be used in an extremely wide range of the toner concentration.

However, while the fixing temperature of the heat fixing roll having a surface layer of a fluorine resin is varied from 120 to 240° C., twisting on the fixing roll is investigated, and it reveals that twisting behavior is exhibited throughout the whole temperature range, and the lowest fixing temperature cannot be evaluated. It is found that high temperature offset remarkably occurs at 180° C. or higher.

Embodiment 3

Preparation of Resin Particle Dispersion (2)

| | |
|---|---|
| Styrene | 290 g |
| n-Butyl acrylate | 110 g |
| Acrylic acid | 6 g |
| Dodecanethiol | 4 g |
| Carbon tetrachloride | 2 g |
| Divinylbenzene | 0.4 g |

The foregoing components are mixed and dissolved to prepare a solution. A surfactant solution formed by dissolving 6 g of a nonionic surfactant (NONIPOL 400, produced by Sanyo Chemical Industries, Ltd.) and 12 g of an anionic surface active agent (NEOGEN SC, produced by Dai-ichi Kogyo Seiyaku Co., Ltd.) in 550 g of ion exchanged water is placed in a flask, and the solution obtained above is dispersed and emulsified therein. The emulsion is slowly stirred over 10 minutes, during which 50 g of ion exchanged water having 4 g of ammonium persulfate dissolved therein is added thereto, followed by substituting with nitrogen. Thereafter, the content of the flask is heated to 70° C. over an oil bath under stirring, and the emulsion polymerization is continued for 5 hours to obtain a resin particle dispersion (2). The resin particles are separated from the resin particle dispersion (2) and measured for various characteristics, and it is found that the mean diameter is 160 nm, the glass transition point is 50.5° C., the weight average molecular weight Mw is 55,000, and the number average molecular weight Mn is 10,200.

Preparation of Pigment Dispersion (2)

| | |
|---|---|
| Yellow pigment (PY180, produced by Clariant Japan Co., Ltd.) | 50 g |
| Anionic surfactant (Neogen SC, produced by Dai-ichi Kogyo Seiyaku Co., Ltd.) | 4 g |
| Ion exchanged water | 200 g |

The foregoing components are mixed and dissolved, and the mixture is dispersed by using a homogenizer (ULTRA-TURRAX, produced by IKA Corp.) and an ultrasonic wave irradiator, so as to obtain a yellow pigment dispersion (2) having a mean diameter of 185 nm.

Preparation of Releasing Agent Dispersion (2)

| | |
|---|---|
| Paraffin wax (HNP 0190, produced by Nippon Seiro Co., Ltd.) | 50 g |
| Anionic surfactant (Neogen SC, produced by Dai-ichi Kogyo Seiyaku Co., Ltd.) | 5 g |
| Ion exchanged water | 200 g |

The foregoing components are heated to 90° C., and the mixture is dispersed by a homogenizer (ULTRA-TURRAX T50, produced by IKA Corp.) and is further subjected to a dispersing treatment by a pressure discharge type homogenizer, so as to obtain a releasing agent dispersion (2) having a mean diameter of 140 nm.

Production of Aggregated Particles

| | |
|---|---|
| Resin particle dispersion (2) | 200 g |
| Pigment dispersion (2) (corresponding to about 10%) | 30 g |
| Releasing agent dispersion (2) | 50 g |
| Aqueous solution (10% by weight) of polyaluminum chloride (produced by Asada Chemical Co., Ltd.) | 1.5 g |

The foregoing components are mixed and dispersed in a round stainless steel flask with a homogenizer (ULTRA-TURRAX T50, produced by IKA Corp.), and is then heated to 45° C. over an oil bath for heating under stirring inside the flask. After maintaining at 45° C. for 30 minutes, observation with an optical microscope reveals that it is confirmed that aggregated particles of about 4 μm are formed. 100 g of the resin particle dispersion (1) is gradually added to the resulting aggregated particle dispersion, and the mixture is heated to 48° C. by increasing the temperature of the oil bath for heating, followed by maintaining at that temperature for 1 hour, whereby an aggregated particle dispersion is obtained.

Observation with an optical microscope reveals that it is confirmed that aggregated particles of about 5.0 μm are formed.

Production of Toner Particles 15 g of a 1N sodium hydroxide solution is added to the resulting aggregated particle dispersion, which is heated to 98° C. with continuous stirring, followed by maintaining at that temperature for 6 hours. Thereafter, it is cooled, filtered and sufficiently washed with ion exchange water to obtain toner particles. The average particle diameter of the toner particles measured with a COULTER COUNTER is 5.0 μm.

Properties of Toner Particles

The resulting toner particles have a volume average particle size distribution index GSDv of 1.20, a shape factor SF1 of 116, which means a substantially spherical shape, and a surface property index of 1.16.

Observation of the surface of the toner with a scanning electron microscope and a transmission electron microscope reveals that relatively large protrusions having a height of 1.5 μm are found on the toner surface, and observation with a transmission electron microscope reveals that plural domains of the releasing agent are present inside the toner. It is found that the releasing agent is present inside the protrusions.

The ratio of carbon atoms ascribed to the releasing agent on the toner surface is quantitatively determined by XPS, and it exhibits a low value of 8.0% by atom.

Preparation of Developer

The toner particles are mixed with 1.5% by weight of silica (TS720, produced by Cabot Corp.), which has an average primary particle size of 12 nm, to obtain an externally added toner. Separately, a ferrite core having an average particle diameter of 50 μm is coated with 1% by weight of polymethyl methacrylate (produced by Souken Kagaku Co., Ltd.) to obtain a carrier. The externally added toner and the carrier are mixed to obtain a developer having a toner concentration of 8% by weight.

Evaluation of Developer

The developer is applied to a modified machine obtained by installing a heat fixing roll having a surface layer of a fluorine resin in a duplicator (DP1250, produced by Fuji Xerox Co., Ltd.) to evaluate image quality, and it reveals that a clear image with no fogging is obtained. The uniformity of the density of a solid image is extremely good. The fog-forming concentration, at which background fog becomes conspicuous, is evaluated by increasing the toner concentration, and it is found the fog-forming concentration is 9%, and the toner can be used in an extremely wide range of the toner concentration.

While the fixing temperature of the heat fixing roll having a surface layer of a fluorine resin is varied from 120 to 240° C., releasing property from the heat fixing roll is investigated, and it reveals that perfect releasing property is obtained throughout the whole temperature range. The fixing degree is determined by scrubbing with cotton waste, and it is found that a sufficient fixing degree is obtained from 125° C., and thus 125° C. is designated as the lowest fixing temperature. While high temperature offset slightly occurs at 240° C. or higher, the temperature range where fixing can be conducted is as extremely wide as 115° C.

Comparative Example 2

In the production of the toner particles in Example 2, after preparing the aggregated particle dispersion, the flask is sealed, and the temperature for fusing in the flask is changed to 102° C. under pressure, which is maintained for 6 hours, with the pH set at 9.0, which is higher than the ordinary pH 6.0, to conduct fusion, whereby toner particles are obtained.

The resulting toner particles have a volume average particle diameter $D_{50}$ of 5.1 μm, a volume average particle size distribution index GSDv of 1.22, a shape factor SF1 of 130, which means a spherical shape, and a surface property index of 2.10.

Observation of the surface of the toner particles with a scanning electron microscope and a transmission electron microscope reveals that large protrusions having a height of 2.5 μm are found on the toner surface, and observation with a transmission electron microscope reveals that the substantial interior of the protrusions is filled with the releasing agent.

However, the ratio of carbon atoms ascribed to the releasing agent on the toner surface quantitatively determined by XPS is as large as 12.5% by atom, and it is found that a large amount of the releasing agent is exposed.

The toner particles are mixed with 1.5% by weight of silica (TS720, produced by Cabot Corp.), which has an average primary particle size of 12 nm, to obtain an externally added toner. Separately, a ferrite core having an average particle diameter of 50 μm is coated with 1% by weight of polymethyl methacrylate (produced by Souken Kagaku Co., Ltd.) to obtain a carrier. The externally added toner and the carrier are mixed to obtain a developer having a toner concentration of 8% by weight.

The developer is applied to a modified machine obtained by installing a heat fixing roll having a surface layer of a fluorine resin in a duplicator (DP1250, produced by Fuji Xerox Co., Ltd.) to evaluate image quality, and it reveals that a clear image is obtained, but fogging is observed on an image of the initial stage. The uniformity of the density of a solid image is poor, and remarkable unevenness in density is observed. The background fog-forming concentration is evaluated by decreasing the toner concentration density and it is found the fog-forming concentration is 6%, and the usable upper limit of the concentration of the toner is considerably low.

While the fixing temperature of the heat fixing roll having a surface layer of a fluorine resin is varied from 120 to 240° C., twisting on the fixing roll is investigated, and it reveals that perfect releasing property is obtained throughout the whole temperature range. The fixing degree is determined by scrubbing with cotton waste, and it is found that a sufficient fixing degree is obtained from 125° C., and thus 125° C. is designated as the lowest fixing temperature. While high temperature offset slightly occurs at 240° C. or higher, good results are obtained in the temperature range where fixing can be conducted. However, the image density is considerably uneven, and fogging is extremely conspicuous.

TABLE 1

| | Example 1 | Example 2 | Comparative Example 1 | Example 3 | Comparative Example 2 |
|---|---|---|---|---|---|
| Production process of toner | Suspension polymerization | Aggregation melt-fusing method | Aggregation melt-fusing method | Aggregation melt-fusing method | Aggregation melt-fusing method |
| Volume average particle diameter $D_{50}$ | 7.5 | 6.0 | 5.9 | 5.0 | 5.1 |
| GSDv | 1.32 | 1.25 | 1.25 | 1.20 | 1.22 |
| Height of protrusions (μm) | 0.4 | 0.8 | 0.02 | 1.5 | 2.5 |
| SF1 | 122 | 120 | 125 | 116 | 130 |
| Surface property index | 1.50 | 1.40 | 1.20 | 1.16 | 2.10 |
| Proportion of element of releasing agent on surface | 5.0 | 4.0 | 1.8 | 8.0 | 12.5 |
| Amount of external additive (% by weight) | 1.2 | 2.0 | 2.0 | 1.5 | 1.5 |
| Fixing releasing property | B | A | C | A | A |
| High temperature offset temperature (° C.) | 200 | 220 | 180 | 240 | 240 |
| Lowest fixing temperature (° C.) | 150 | 130 | — | 125 | 125 |
| Fog-forming concentration of toner (%) | 12 | 10 | 10 | 9 | 5 |
| Uniformity of solid image | C | A | A | A | D |

[Evaluation Standard]
(Releasing Property)
A: No problem occurs throughout the whole evaluation temperature range.
B: Slight tendency of twisting is found depending on the temperature, but there is substantially no problem.
C: A temperature where releasing cannot be conducted is present.
(Uniformity of Solid Image)
A: Completely no image unevenness is found.
B: Slight image unevenness is found, but there is no practical problem.
C: Slight image unevenness is found but is in the allowable level.
D: Considerable image unevenness is found and is not allowable.

In the invention employing the constitution described in the foregoing, the followings are realized even when the oilless fixing process is employed. Both the fixing releasing property and the transferring and developing properties can be achieved; the lowest fixing temperature can be decreased; the high temperature offset can be prevented; and good image preservation property can be obtained, whereby an image of good quality can be provided.

The entire disclosure of Japanese Patent Application No. 2000-268679 filed on Sep. 5, 2000 including specification, claims and abstract is incorporated herein by reference in its entirety.

What is claimed is:

1. A toner for developing an electrostatic image comprising a resin, a colorant and a releasing agent, wherein the toner has protrusions having a height of approximately 0.05 μm to 2 μm on the surface thereof, a part of the protrusions contain the releasing agent inside thereof, and the toner is characterized by a ratio of an element derived from the releasing agent to the elements on the surface of the toner determined by X-ray photoelectron spectroscopy, the element ratio being smaller than 10% by atom.

2. The toner for developing an electrostatic image as claimed in claim 1, wherein the protrusions have a height of approximately from 0.1 to 1 μm.

3. The toner for developing an electrostatic image as claimed in claim 1, wherein at least the part of the protrusions containing the releasing agent inside are formed by migration of the releasing agent.

4. The toner for developing an electrostatic image as claimed in claim 1, wherein the releasing agent in the protrusions has an acicular form.

5. The toner for developing an electrostatic image as claimed in claim 1, wherein the toner has an external additive added to a surface of the toner particles, and the external additive has an average primary particle diameter of about 0.2 μm. or less, and the external additive is added in an amount of about from 1 to 3 parts by weight per 100 parts by weight of the toner.

6. The toner for developing an electrostatic image as claimed in claim 1, wherein the toner has a volume average particle diameter ($D_{50}$) of about from 2 to 10 μm.

7. The toner for developing an electrostatic image as claimed in claim 1, wherein the toner has a shape factor SF1 of about from 100 to 140, the SF1 being defined by the following equation:

$$SF1=(ML^2/A)\times(\pi/4)\times 100$$

wherein ML represents a maximum length of the toner particles, and A represents a projected area of the toner particles.

8. The toner for developing an electrostatic image as claimed in claim 1, wherein the toner has a volume average particle size distribution index GSDv of about 1.25 or less, the GSDv being defined by the following equation:

$$GSDv=(D_{84v}/D_{16v})^{0.5}$$

wherein $D_{84v}$ represents a diameter (μm) at which the volume accumulated particle distribution becomes 84%, and $D_{16v}$ represents a diameter (μm) at which the volume accumulated particle distribution becomes 16%.

9. The toner for developing an electrostatic image as claimed in claim 1, wherein the releasing agent is selected from the group consisting of polyethylene wax, paraffin wax, Fischer-Tropsch wax and nitrogen containing wax.

10. A developer for developing an electrostatic image, the developer comprising a toner and a carrier, wherein the toner has protrusions having a height of approximately 0.05 μm to 2 μm on the surface thereof, a part of the protrusions contain a releasing agent inside thereof, and a ratio of an element derived from the releasing agent to the elements on the surface of the toner determined by X-ray photoelectron spectroscopy, the element ratio being smaller than 10% by atom.

11. The developer as claimed in claim 10, wherein the toner has a volume average particle size distribution index GSDv of about 1.25 or less.

12. A process for producing the toner for developing an electrostatic image claimed in claim 1, the process comprising:

mixing at least a resin particle dispersion and a releasing agent dispersion to prepare an aggregated particle dispersion;

heating the aggregated particle dispersion to form the toner particles; and forming protrusions on a surface of the toner by migration of the releasing agent.

13. The process as claimed in claim 12, wherein the step of heating the aggregated particles dispersion comprises an intermediate step of heating at a temperature in a range of ±20° C. from the melting point of the releasing agent, for 2 to 10 hours.

14. A process for forming an image, comprising:

forming an electrostatic latent image on an electrostatic image holding member;

developing the electrostatic latent image with the developer as claimed in claim 10 on a developer holding member to form a toner image;

transferring the toner image to a transfer material; and fixing the toner image on the transfer material.

15. The process as claimed in claim 14, further comprising:

recovering the toner remaining on the electrostatic image holding member and reusing the toner in the developing step.

16. The process as claimed in claim 14, wherein the transferring step comprises a step of transferring the toner image to an intermediate transfer material, and a step of transferring the toner image to a final transfer material.

17. The process as claimed in claim 14, wherein the fixing step employs an oilless fixing process.

* * * * *